United States Patent [19]

Fowler et al.

[11] 4,342,487

[45] Aug. 3, 1982

[54] AUTOMATIC ROOF BOLTING DRILL RETENTION APPARATUS

[75] Inventors: J. Alan Fowler, Monroeville Borough; George S. Haller, North Huntingdon Township, Westmoreland County; C. David Rogers, Monroeville Borough, all of Pa.

[73] Assignee: United States Steel Corporation, Pittsburgh, Pa.

[21] Appl. No.: 126,059

[22] Filed: Feb. 29, 1980

[51] Int. Cl.[3] ..... F16C 29/10

[52] U.S. Cl. ..... 308/3.9; 308/3 R

[58] Field of Search ..... 308/3.9, 237 R, 75, 308/3 R; 405/303; 175/220

[56] References Cited

U.S. PATENT DOCUMENTS

| | | | |
|---|---|---|---|
| 2,365,683 | 12/1944 | Curtis et al. | 308/3.9 |
| 3,441,323 | 4/1969 | Vincent et al. | 308/3.9 |
| 4,226,559 | 10/1980 | Prebensen | 405/303 |

*Primary Examiner*—Lenard A. Footland

*Attorney, Agent, or Firm*—William A. Danchuk; John F. Carney; George D. Dickos

[57] ABSTRACT

A drill steel support assembly for a mining roof bolting machine is presented. The assembly is utilized for retaining and guiding a drill steel on a roof bolting machine during the collaring of the drill steel in the mine roof. Once collared, the drill steel is released by the retaining assembly inasmuch as the latter is not necessary for support purposes after collaring has occurred. The release of the drill steel from the retaining assembly is accomplished when the vibrations from the drill steel are sufficient to open the support mechanism once the drill has been collared.

4 Claims, 3 Drawing Figures

AUTOMATIC ROOF BOLTING DRILL RETENTION APPARATUS

BACKGROUND OF THE INVENTION

Mining roof bolting machines have previously utilized either ineffective or dangerous methods for retaining the roof bolt drill steel during initial stages of drilling operation in a substantially vertical orientation during the collaring of the drill steel in the mine roof. Collaring is achieved when the drill steel and bit have entered the mine roof to an extent of approximately nine inches to one foot. Once collared, the supporting system for the drill steel is no longer necessary because of the retentive force the roof provides to the upper portion of the drill steel.

Past operations have utilized the dangerous practice of having the roof bolt operator hold and guide the drill steel during the collaring process. This has been inefficient and dangerous from two standpoints. First, there is the danger that the hand of the roof bolt operator may be caught between the drill steel and the roof bolter, thereby causing unnecessary injury to the operator himself. Secondly, the mine operator may be in a position in which he does not retain the drill steel in a substantially vertical direction thereby causing an angular drilling of the roof bolt hole and possible danger to the drill steel, or, alternatively, the drilling of a substantially non-vertical hole in the mine roof. Various methods have been attempted in the past to retain the drill steel at the upper portion of the drill head without success. For the most part, these previous methods have employed devices which must be mechanically removed once the drill has been collared.

SUMMARY OF THE INVENTION

The present invention is addressed to an "automatically" releasable drill steel retention assembly which is clamped around the drill steel at the initial start-up of the drilling and which is released when the drill has been collared and the vibration from the drill steel increases. Should the automatic release function of the present retention assembly be inoperative for some reason, there is a manual release operation which may be performed by the roof drill operator.

The retention assembly consists of two housing portions, one of which is rigidly attached to a portion of the roof drill itself, while the other is hinged to the first portion of the housing. Magnets are utilized to retain the two sections in a closed relationship about the drill steel for the support thereof. A nylon or anti-friction insert is placed in an aperture between the two housing sections for decreasing the frictional co-efficient between the drill steel and the metallic circumference of the aperture contained within the housing. Upon start-up, the drill is placed in the aperture and the two sections are closed and held magnetically closed until the drilling operation has proceeded to the collaring stage. Once the drill is collared, the vibrations from the drill steel are sufficient to separate the two housing sections from one another and drilling proceeds normally.

Accordingly, it is a general feature and object of the present invention to provide a drill steel retention assembly which is automatically releasable when the drill steel has been collared in the mine roof.

It is another object and feature of the present invention to provide a drill steel retention assembly for a mine roof bolter which does not require the drill operator to contact the drill steel during collaring, thereby reducing the probability of injury to the drill operator.

Another object and feature of the present invention is to provide a drill steel retention assembly which utilizes a magnetic force to retain two halves of the assembly in a closed relationship until the drill steel is collared in which case the vibrations from the collared drill steel are sufficient to break the magnetic force holding the two sections together, thereby releasing the retention force upon the drill steel.

Other objects and features of the present invention will, in part, be obvious and will, in part, become apparent as the following description proceeds. The features of novelty which characterize the invention will be pointed out with particularity in the claims, annexed to and forming part of the specification.

BRIEF DESCRIPTION OF THE DRAWINGS

The novel features which are considered characteristic of the invention are set forth with particularity in the appended claims. The invention itself, however, both as to its structure as well as its operation, together with the additional objects and advantages thereof will best be understood from the following description of the preferred embodiment of the present invention when read in conjunction with the accompanying drawings wherein:

DETAILED DESCRIPTION OF THE DRAWINGS

Figure 1:
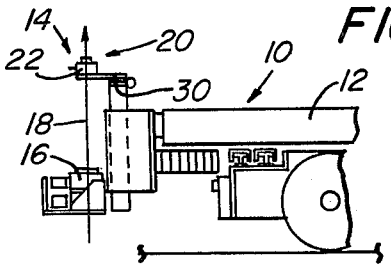
FIG. 1 is a side elevational view of the front end portion of a roof bolting machine incorporating the retention assembly of the present invention.

Looking to FIG. 1, there is shown the front portion 10 of a mine roof bolt drilling apparatus. The drilling apparatus includes a boom mechanism 12 having a pivot point at the rear (not shown) of the drilling apparatus and a drilling end 14. The drilling end 14 generally includes a rotatable motor unit 16 which is used to provide rotational and thrust forces to a drill steel 18 the bottom of which sits in a recess (not shown) in the drill box 16. Located at the upper end of the front end of the roof drilling machine is a drill steel support portion 20. A drill steel retention assembly according to the present invention is shown at 22.

Figure 2:
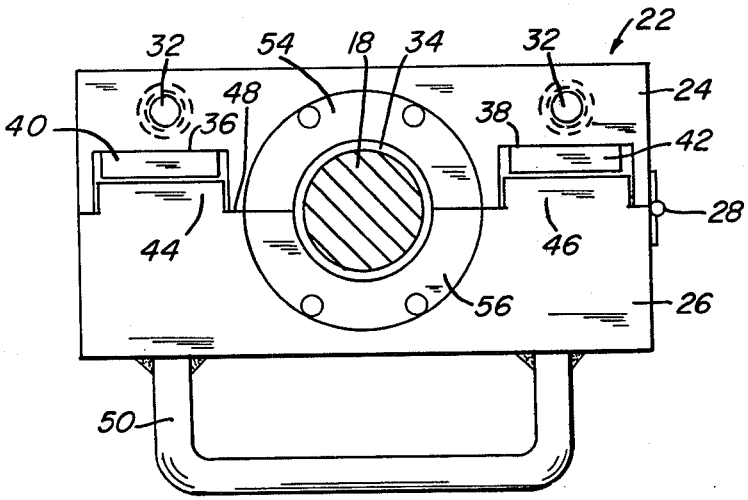
FIG. 2 is a plan view of the retention assembly of the present invention in a closed and retentive position.
Figure 3:
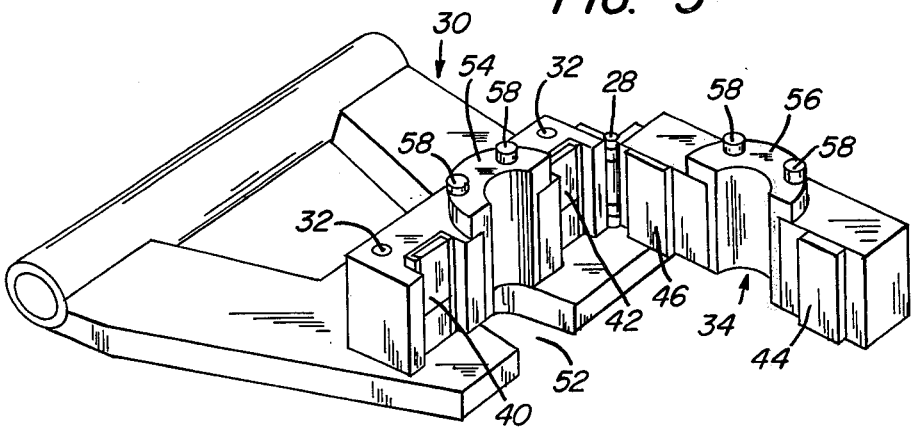
FIG. 3 is a prospective view of the retention assembly of the present invention in an opened and non-retentive position.

Looking to FIG. 2, there is shown a plan view of the drill steel retention assembly 22. The assembly is generally comprised of two housing sections 24 and 26 pivotally attached to each other through a hinge arrangement 28. The first housing portion 24 is rigidly attached to an A-frame extension 30 at the front of the drilling machine (as seen in FIG. 3). The first housing portion 24 is attached to the A-frame through bolts or the like as at 32.

When the two housing sections are in their closed position (as seen in FIG. 2) there is formed an aperture 34 through which the drill steel 18 passes. Located on either side of the aperture 34 are cut-away portions 36 and 38 in the first housing section 24 which are employed to rigidly contain magnets 40 and 42. The magnets 40 and 42 are held within the cut-out portions 36 and 38 by any appropriate means such as bolting or the like. A second housing section 26 is configured having extensions 44 and 46 which extend beyond the flat face 48 at the front of the second housing section 26. These extensions 44 and 46 are configured to mate into the cut-away portions 36 and 38 and to contact the magnets 40 and 42 as shown in FIG. 2. When in this configuration, the two housing sections are secured to each other through the magnetic attraction between the magnets 40 and 42 and the metal extensions 44 and 46 of the second housing section 26. A handle 50 is provided on the outside of second housing section 26 for manually opening or closing the two housing sections with respect to one another.

Looking to FIG. 3, there is shown a perspective view of the retention assembly of the present invention located on the A-frame 30 of the roof bolter 10. As shown therein, a cut-away portion 52 is provided at the very front of the A-frame 30 to allow the roof drill steel to be placed within the aperture 34 provided within the two housing sections 24 and 26. Anti-friction inserts such as at 54 and 56 are provided so as to reduce the friction between the drill steel 18 and the steel forming the aperture 34. The inserts 54 and 56 may be formed from Teflon or nylon or any anti-friction material and are rigidly attached to the two hemispheres via any appropriate bolting or screwing system as at 58.

In operation, the drill steel is placed first in the drill box 16 and is then elevated into a substantially vertical orientation by placing the drill steel into the opening 52 as shown in FIG. 3. In this position, the drill steel resides within the aperture 34 formed between the two halves of the housing when the two are closed. When the drill steel is properly located within the aperture 34, the two housing sections are closed with respect to one another forming an arrangement shown in FIG. 2. The magnetic holding force provided by magnets 40 and 42. is of sufficient force to retain the two housing sections together thereby retaining and guiding the drill steel in a substantially vertical manner as the drill boom 12 is elevated to contact the head of the drill steel with the mine roof.

Rotational drilling is then commenced and when the drill steel has penetrated the mine roof of approximately 9 inches to 1 foot, the drill is "collared". Once collared, the drill steel 18 is supported at its top end by the holes formed in the mine roof and at its bottom end by the drill box 16. At this stage, the retention abilities of the assembly 22 are no longer necessary. Applicant's experiments have shown that a magnetic holding force of 5 to 6 pounds provided by the two magnets 40 and 42 is sufficient to retain the two housing portions together until this stage of the drilling operation has been achieved. Once collared, vibrations are set up in the drill steel which are of sufficient magnitude to force the outer periphery of the drill steel into contact with the nylon inserts 54 and 56 thereby providing a lateral opening force to the two housing sections 24 and 26 and swinging the second housing section 26 outwardly from the first to a position shown in FIG. 3. Accordingly, there is provided an automatic opening of the retention assembly when the drill is collared and such retention operation is no longer required.

While applicant has shown magnets as provided the retention force between the two housing sections, it should be apparent that any moderate force holding apparatus may be used. Additionally, while Teflon and nylon have been named as the anti-frictional members 54 and 56, it should be apparent to those skilled in the art that any anti-friction material inserts may be used.

In conclusion, it may be seen that there is provided a very simple and easily operable retention assembly for a drill steel employed by a mine roof bolting machine to drill vertically oriented holes within a mine roof. The assembly obviates the need for the drill operator to hold the drill steel in a substantially vertical position during the collaring operation of the drill. Additionally, the selective use of low force magnets provides an added advantage in that the retention assembly is automatically opened when the drill steel has been collared and the normal vibrations set up during drilling operation at this stage are sufficient to provide lateral forces to the housing sections for the automatic opening of the retention assembly when it is no longer required.

While certain changes may be made in the above noted apparatus without departing from the scope of the invention herein involved, it is intended that all matter contained in the above description or shown in the accompanying drawings, shall be interpreted as illustrative and not in a limiting sense.

We claim:

1. Drill steel guide apparatus for selectively retaining and guiding a drill steel of a drilling machine during collaring in a rock face, said guide apparatus comprising:

a housing for guiding said drill steel including a first portion attached to said drilling machine and a second portion pivotally mounted on said first portion to move said second portion in one direction toward said first portion for guidingly engaging said drill steel and in a second direction away from said first portion for releasing said drill steel from said housing, magnet means operable between said first and second housing portions to retain said portions together when said second portion is in its drill steel-engaging position with respect to said first portion, said magnet means providing a holding force of at least five pounds effective to retain said first and second housing portions together until vibrations produced by collaring of said drill steel are sufficient to break said holding force and release said housing portions from engagement with said drill steel.

2. Apparatus according to claim 1 in which said magnet means comprises at least one magnet mounted in at least one of said housing portions.

3. Apparatus according to claim 2 in which said first and second housing portions each contain a segment of a friction rendering bushing configured, when said housing portions are together, to define a friction reducing aperture through said housing to guide said drill steel.

4. Apparatus according to claim 3 in which said bushing is nylon.

* * * * *